United States Patent [19]

Fuller, Jr.

[11] 4,124,012

[45] Nov. 7, 1978

[54] FUEL SAVING APPARATUS AND SPARK PLUG THEREFOR

[76] Inventor: Harold L. Fuller, Jr., 325 Pennsylvania Ave., Washington, D.C. 20003

[21] Appl. No.: 790,911

[22] Filed: Apr. 26, 1977

[51] Int. Cl.[2] ..... F02D 13/06

[52] U.S. Cl. ..... 123/198 F; 123/148 A; 123/182

[58] Field of Search ..... 123/198 F, 148 A, 182

[56] References Cited

U.S. PATENT DOCUMENTS

| | | | |
|---|---|---|---|
| 1,283,780 | 11/1918 | Huid | 123/198 F |
| 1,358,459 | 11/1920 | Pache | 123/198 F |
| 1,398,651 | 11/1921 | Rowledge | 123/198 F |
| 2,114,655 | 4/1938 | Leibing | 123/198 F |
| 2,443,999 | 6/1948 | Wright | 123/198 F |
| 2,675,789 | 4/1954 | Watkins et al. | 123/198 F |
| 2,745,391 | 5/1956 | Winder, Jr. | 123/198 F X |
| 4,018,204 | 4/1977 | Rano, Jr. | 123/198 F |

*Primary Examiner*—Ira S. Lazarus

*Attorney, Agent, or Firm*—Schuyler, Birch, Swindler, McKie & Beckett

[57] ABSTRACT

A fuel saving apparatus for an internal combustion engine having a plurality of cylinders each having a spark plug therein. The apparatus comprises a valve means for stopping fuel flow to predetermined cylinders and means for venting each of these cylinders to atmosphere through the spark plugs therein. The venting means comprises a spark plug having a hollow shell releasably engaged in the cylinder and including a casing therein which is slidably movable relative to the shell. An air discharge passageway is provided between the casing and the shell, and a valve on the casing closes the inner end of the shell. Suitable actuating means are provided for moving the casing to an operative position where the valve opens the inner end of the shell thus venting the cylinder through the air discharge passageway and an outlet port in the shell communicating with atmosphere. Control means are provided for cutting the predetermined cylinders out of firing operation when less than full load conditions are imposed on the engine by operating the venting and valve means.

10 Claims, 5 Drawing Figures

FUEL SAVING APPARATUS AND SPARK PLUG THEREFOR

BACKGROUND OF THE INVENTION

1. Field of the Invention

The present invention relates to a fuel saving apparatus for an internal combustion engine and, more particularly, to an apparatus having a novel spark plug allowing predetermined cylinders to be vented through the spark plugs therein simultaneously with fuel cutoff to those cylinders.

2. Description of the Prior Art

It is well known to conserve fuel in an internal combustion engine by cutting various of the cylinders of the engine out of firing operation when less than full load conditions are imposed on the engine. U.S. Pat. No. 1,201,055 issued to Jones is an early example of this principle. In Jones, supra, the normal exhaust valves of the unused cylinders are operated by a rod to port the cylinders to atmosphere through the exhaust manifold while butterfly valves are simultaneously operated by a mechanical linkage to cut off the fuel flow to the cylinders. U.S. Pat. No. 2,745,391 to Winkler is a further example of another cylinder cutout device which closes the normal intake and exhaust valves for the cylinders in the engine to conserve fuel.

Those devices which cut out selected cylinders by operating the normal intake and exhaust valves for those cylinders have various disadvantages. For example, such devices must be quite complex to couple the valves to their operating camshaft and yet allow the valves to be selectively uncoupled therefrom to cut the cylinder out of operation. As shown in Winkler, supra, and U.S. Pat. No. 3,964,455 to Brown, such valve operating mechanisms often include complicated hydraulic actuators. Such actuators increase the complexity and cost of the device and also are prone to mechanical breakdown. Purely mechanical connections for uncoupling the intake and exhaust valves are similarly complicated and difficult to keep running in error free operation considering the continual motion of the intake and exhaust valves as operated by the camshaft.

SUMMARY OF THE INVENTION

Accordingly, it is an object of the present invention to provide an improved fuel saving apparatus which is selectively operable to cut predetermined cylinders in an internal combustion engine out of firing operation. The apparatus is capable of venting each of the predetermined cylinders to atmosphere through the spark plug therein.

It is an additional object of the present invention to provide a fuel saving apparatus for an internal combustion engine which effects a cut out of predetermined cylinders from firing operation while leaving the intake and exhaust valves in each cylinder operating in their normal mode.

The fuel saving apparatus of the present invention is adapted for use on an internal combustion engine having a plurality of cylinders each provided with a piston and spark plug. The apparatus comprises a means having an operative position for selectively preventing fuel flow to predetermined cylinders in the engine. In addition, a venting means is provided having an operative position for venting each of the predetermined cylinders to atmosphere through the corresponding spark plugs therein. A control means selectively cuts the predetermined cylinders out of firing operation by moving the valve means and the venting means to their operative positions when less than full load conditions are imposed on the engine.

The venting of the cylinders is accomplished by means of a novel spark plug comprising a hollow shell having inner and outer ends, the shell having a releasable engagement at its inner end with the cylinder and extending outwardly therefrom. An actuator comprising a hollow casing is located inside the shell and has an insulator fixedly supported therein, the insulator carrying a first electrode disposed in a spaced relationship to a second electrode carried by the casing. At least one axially extending air discharge passageway is formed between the casing and the shell. The passageway communicates at one end thereof with at least one outlet port located in the shell. In addition, the casing is provided with a valve for closing the inner end of the shell and is slideably supported for reciprocal motion relative to the shell. Means are provided for moving the spark plug from a first position where the valve means closes the inner end of the shell to a second position where the valve means opens the inner end of the shell thereby venting the cylinder through the air discharge passageway and the oulet port.

BRIEF DESCRIPTION OF THE DRAWINGS

The novel features of the invention are set out with particularity in the claims, but the invention will be understood more fully and clearly from the following detailed description of a preferred embodiment of the invention as set forth in the accompanying drawings, in which:

DESCRIPTION OF A PREFERRED EMBODIMENT

Figure 1:
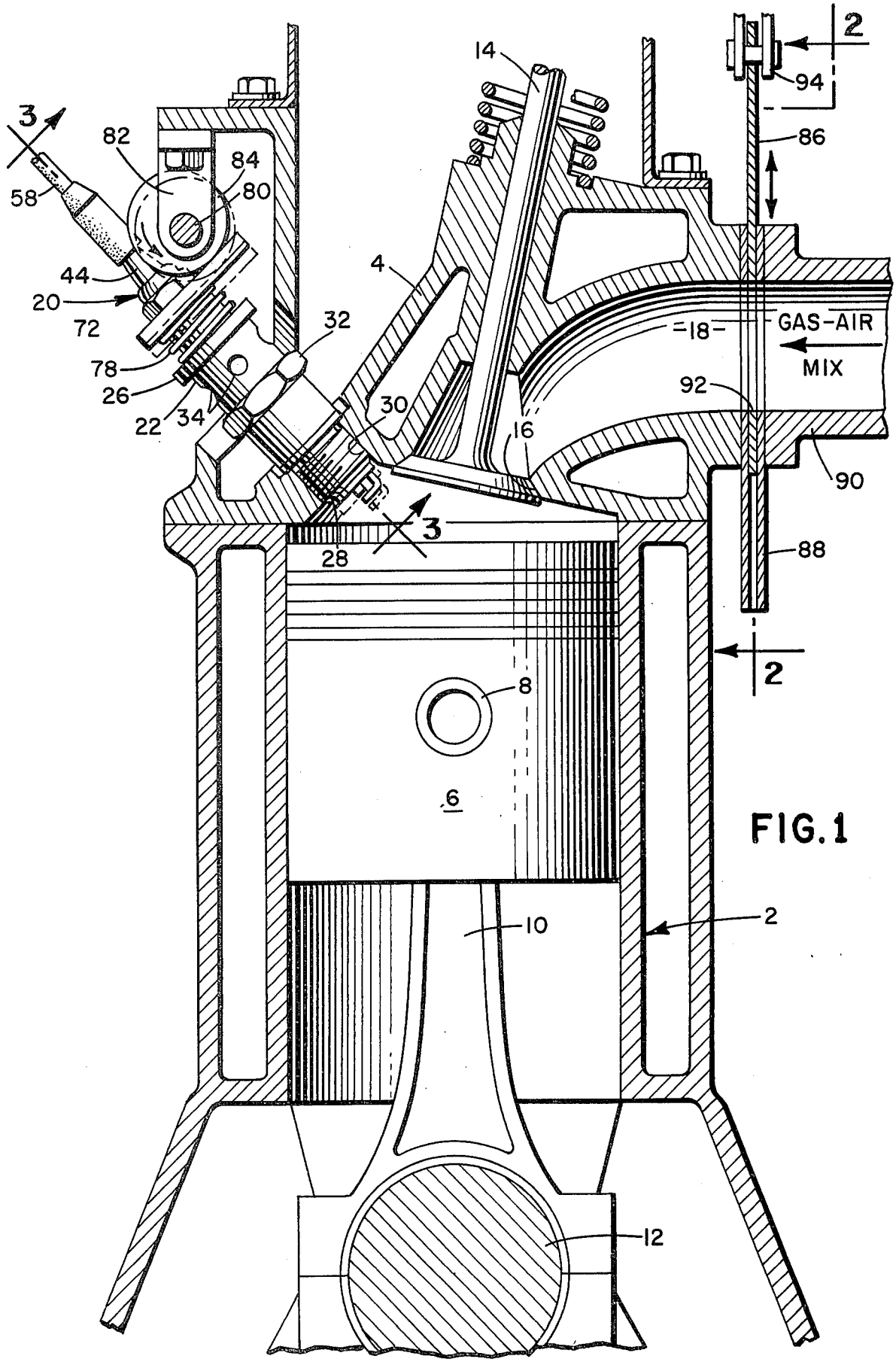
FIG. 1 is a cross sectional view of a fuel saving apparatus according to the present invention.
Figure 2:
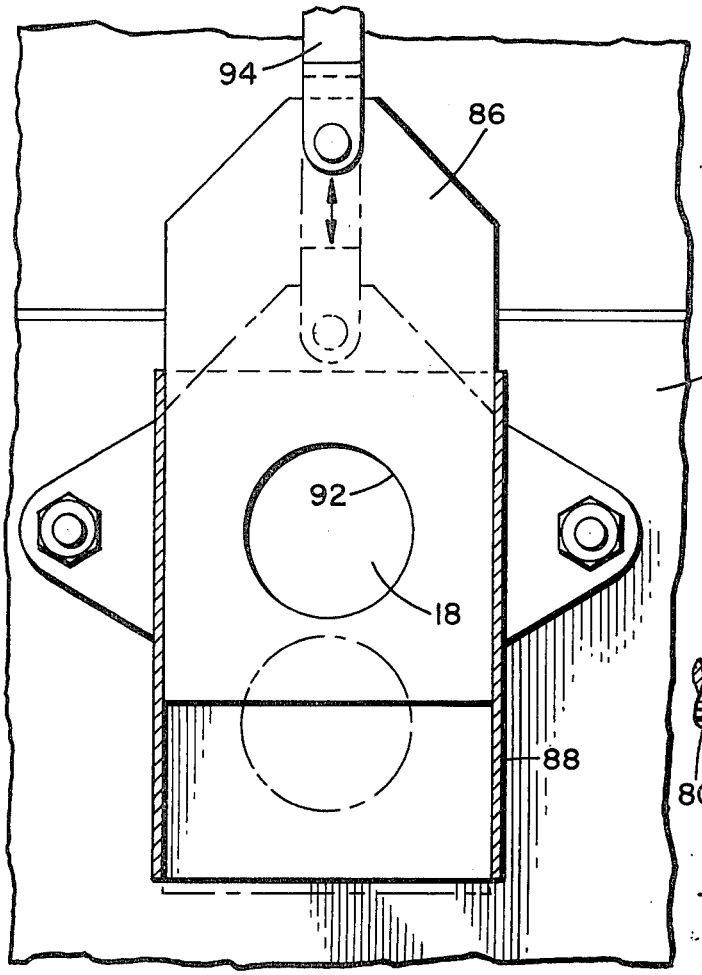
FIG. 2 is a cross sectional view along line 2—2 of FIG. 1.

Referring to FIG. 1, a cylinder 2 of a typical internal combustion engine is closed at its upper end by a cylinder head 4. Cylinder 2 has a piston 6 which is pivotally secured to the upper end of connecting rod 10 by a pin 8; the lower end of rod 10 is attached to the crankshaft 12 of the engine. A conventional fuel intake valve 14 has a valve seat 16 for closing a fuel intake passageway 18 which is located in cylinder head 4 and which is supplied with the fuel-air mixture generated by the engine's carburetor (not shown). Intake valve 14 is continuously operated by a constantly rotating camshaft (not shown) to periodically release into cylinder 2 the fuel-air mixture in passageway 18. Cylinder 2 is also provided with a conventional exhaust valve (not shown) operatively coupled to the camshaft. A spark plug 20 extends through cylinder head 4 to ignite the fuel-air mixture compressed by piston 6 in cylinder 2. Although only one cylinder 2 has been described herein, the internal combustion engine comprises a plurality of identical cylinders 2 and is used to power various types of movable vehicles. The present invention is primarily meant for use with engines in automobiles, but it can be used for any type of internal combustion engine where fuel conservation is desirable.

Figure 3:
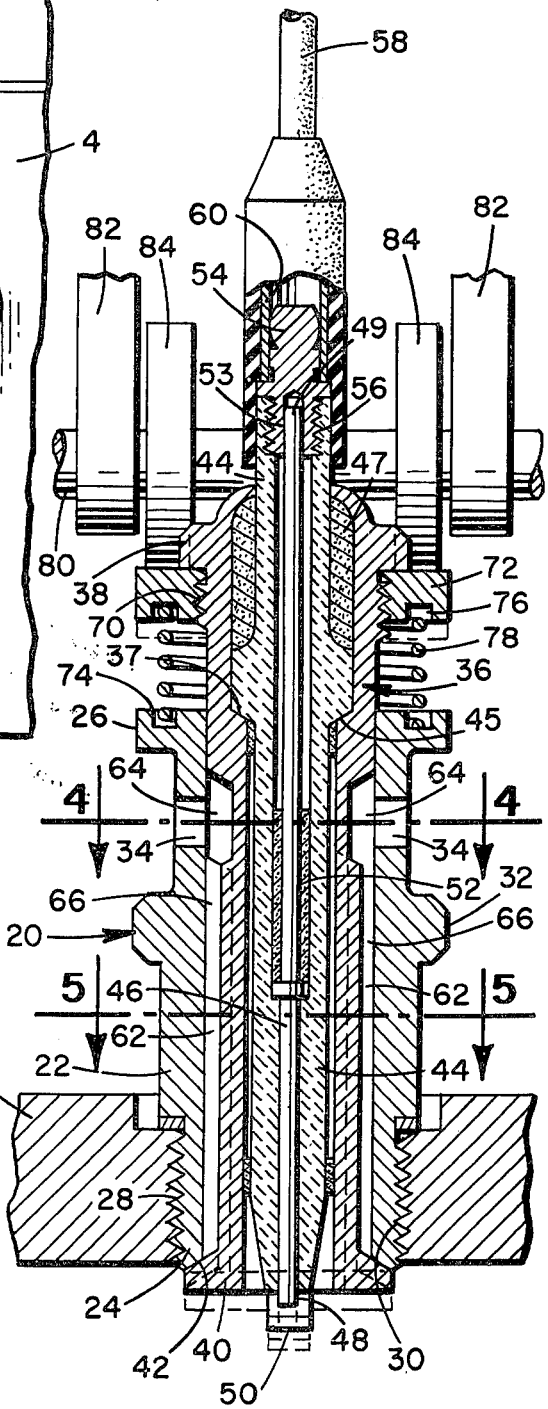
FIG. 3 is a cross sectional view along line 3—3 of FIG. 1.

Referring now to both FIGS. 1 and 3, the novel spark plug 20 of the present invention comprises a substantially cylindrical, hollow shell 22 having an inner end 24 and an outer end 26. Inner end 24 of shell 22 has a plurality of external threads 28 for releasably engaging an internally threaded bore 30 in cylinder head 4. In addition, the outer surface of shell 22 between the ends 26 and 28 thereof has a plurality of appropriately shaped wrench flats 32 which may be engaged by a wrench or similar device so that spark plug 20 can be removed and installed from the threaded bore 30 in cylinder head 4. Four outlet ports 34, equally spaced around the circumference of shell 22 above the wrench flats 32, extend between the inner and outer surfaces of shell 22 to provide atmospheric communication to the interior thereof. Shell 22 may be made of any suitable metallic material as is conventional in the production of spark plugs.

An actuator comprising a substantially cylindrical metallic casing 36 is slidably received inside shell 22 for reciprocal movement relative thereto. Casing 36 has an upper portion 38 and a lower portion 40 terminating in an annular valve seat 42 which is adapted to close inner end 24 of shell 22. A ceramic insulator 44 is fixedly supported inside casing 36 for movement therewith. Casing 36 has an annular shoulder 37 on its inner surface forcibly engaging an annular shoulder 45 on the outer surface of insulator 44 to provide the rigid coupling between the casing 36 and insulator 44. In addition, a hardenable sealing material 47 tightly fills the space between casing 36 and insulator 44 above the engaged shoulders 37, 45 to enhance the coupling therebetween.

Insulator 44 rigidly supports an elongated center electrode 46 having a lower end 48 disposed in a spaced relationship to a side electrode 50 fixedly attached to casing 36. A hardenable sealing material 52, similar to the material 47, is used between the center electrode 46 and the insulator 44. The upper end 49 of electrode 46 has a tight-fitting engagement in an internal bore 53 provided in a metallic terminal 54. Terminal 54 has a threaded connection 56 at its lower end to the outer end of ceramic insulator 44 which suitably extends above the upper portion 38 of casing 36. An electrical cable 58 having a metallic coating 60 contacting the outer end of terminal 54 supplies electrical power from the vehicle electrical system to terminal 54 and, consequently, to center electrode 46. The electrical circuit for spark plug 20 is completed through side electrode 50 which is suitably grounded through the upper portion 38 of casing 36 to shell 22 and cylinder head 4.

Figure 4:
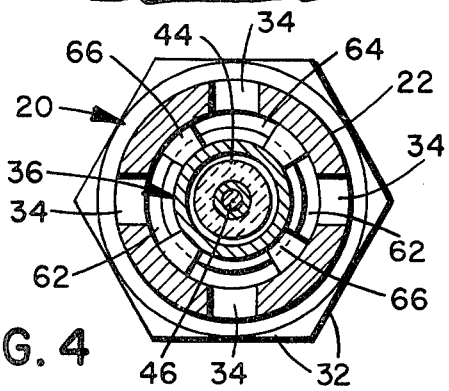
FIG. 4 is a cross sectional view along line 4—4 of FIG. 3.
Figure 5:
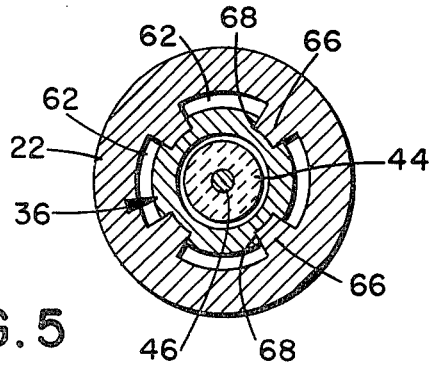
FIG. 5 is a cross sectional view along line 5—5 of FIG. 3.

Referring to FIGS. 3-5, a plurality of air discharge passageways 62 are formed between shell 22 and the lower portion 38 of casing 36. Each of the passageways 62 terminates at one end in an annular chamber 64 communicating with each of the outlet ports 34 in shell 22. A plurality of axially extending ribs 66 extend inwardly from the inner surface of shell 22 to be received in corresponding grooves 68 in the outer surface of casing 36. Ribs 66 help guide the casing 36 during its reciprocal motion relative to shell 22; the air discharge passageways 62 are formed between adjacent ribs 66. Passageways 62 are formed because the lower portion 38 of casing 36 has a smaller diameter than the diameter of shell 22.

Outer end 38 of casing 36 extends above outer end 26 of shell 22 and is provided with external threads 70 which releasably engage an internally threaded cam follower ring 72. Ring 72 when attached to casing 36 is positioned directly above outer end 26 of casing 22. Outer end 26 is provided with an upwardly extending annular groove 74 and the lower surface of ring 72 has a downwardly extending annular groove 76. A compression spring 78 having its ends respectively received in grooves 74 and 76 normally biases the casing 36 upwardly until valve seat 42 closes the inner end 24 of shell 22 thereby sealing cylinder 2 for normal engine operation. In addition, the compression of gases in the cylinder 2 tends to urge valve seat 42 to the closed position.

Referring now to FIG. 1, a rod 80 is rotatably supported in a bracket 82 which is fixed to a stationary portion of the engine such that rod 80 is closely adjacent the ring 72 on casing 36. Two cam rollers 34 are eccentrically mounted on rod 80 and are adapted to bear against a portion of the outer surface of ring 72. In addition, slideable valve plate 86 is mounted in a gasket 88 provided between fuel intake passageway 18 and an intake manifold 90 or other passageway leading to the carburetor of the engine. Valve plate 86 has a circular opening 92 having a first position registering with the passageways 18 and 90 to allow the fuel-air mixture to be dispensed into cylinder 2 under control of intake valve 16. However, an operating linkage 94 is connected to the upper end of the valve plate 86 for reciprocating the valve plate 86 to an operative position where opening 92 is disposed out of its registering connection with passageways 18 and 90 to prevent the flow of fuel to cylinder 2.

Both the rod 80 and the operating linkage 94 are connected to a suitable operating means, such as an electrically operated solenoid (not shown), which is actuated by control means (not shown) responsive to less than full load conditions on the engine. When the control means energizes the solenoid, rod 80 is rotated until rollers 84 reach their dotted line positions to move the casing 36 of spark plug 20 downwardly to an operative position where valve seat 42 opens the lower end 24 of shell 22 thereby venting cylinder 2 through the air discharge passageways 62, chamber 64, and outlet ports 34. In addition, operating linkage 94 is operated to move slideable valve plate 86 down to its operative dotted line position to block the flow of fuel into intake passageway 18 and cylinder 2. Thus, cylinder 2 has been effectively cut out of the firing operation of the engine thereby decreasing the amount of fuel being consumed by the engine.

Because the cylinder 2 is vented through the spark plug 20, little or no compression of gases takes place inside the unused cylinder 2. Although the compression of gases in an unvented cylinder might be thought not to result in a net energy loss since the gases also expand on the downward stroke of piston 6, it must be remembered that some energy will always be lost in the heat expended when the air in cylinder 2 is compressed by piston 6. Thus, whenever the control means senses that less than full load conditions are imposed on the engine, then any suitable number of predetermined cylinders 2 of the engine can be cut out of firing operation to conserve fuel. The number of cylinders to be cut out and their location in the engine may be varied within wide ranges. In addition, the normal opening of the cylinder intake and exhaust valves will assist in keeping compression to a minimum.

The control means for sensing less than full load conditions on the engine may be any suitable electrical or mechanical means commonly available to sense appropriate engine variables such as speed, operating temperature of the engine and the like. One such electrical control means that might be used in energizing the solenoid which operates rod 80 and linkage 94 is that disclosed in U.S. Pat. No. 2,745,391 to Winkler which is herein incorporated by reference. In addition, the control means could comprise a switch which the driver of the vehicle could manually operate whenever less than full load conditions are indicated. In any event, the control means will cut the predetermined cylinders 2 out of firing operation whenever the engine has reached an efficient cruising speed and does not need all the power generated by all the cylinders 2 in the engine, such as when the automobile is travelling on the staight and level. Thus, the present invention will greatly increase the gasoline mileage of today's automobiles.

The present invention may be incorporated integrally into the engine of a new automobile or it may preferably be used as an accessory type add-on device for an engine of an existing automobile. In the latter event, the conventional spark plugs and intake manifold gaskets are first removed for those cylinders it is desired to control and are respectively replaced with the spark plugs 20 and the gaskets 88 having the slidable valve plates 86 therein. The rod 80, rollers 82 and operating linkages 94 are then connected to their respective elements and are suitably supported on the engine or vehicle frame for operation by the solenoid and control means.

Although the present invention has been illustrated in terms of a preferred embodiment, it will be obvious to one of ordinary skill in the art that numerous modifications may be made without departing from the true spirit and scope of the invention. For example, although outlet ports 34 have been shown herein as communicating directly with atmosphere, it will often be desirable for noise attenuation to connect the ports 34 to atmosphere through a muffler. In addition, side electrode 50 could also be fixed in shell 22, rather than in casing 36, provided center electrode 46 does not interfere with or contact the side electrode 50 when the casing 36 is in its operative position with valve 42 maintained in its open position. The scope of the present invention is therefore to be limited only by the appended claims.

I claim:

1. A fuel saving apparatus for an internal combustion engine having a plurality of cylinders each provided with a piston and a spark plug, comprising:

means for selectively preventing fuel flow to predetermined ones of said cylinders when in an operative position;

venting means having an operative position for venting each of said predetermined cylinders to atmosphere through said corresponding spark plugs therein; and control means for selectively cutting said predetermined cylinders out of firing operation by conjointly operating said means for preventing fuel flow and operating said venting means to said operative positions when less than full load conditions are imposed on said engine.

2. A fuel saving apparatus according to claim 1, wherein said venting means comprises at least one selectively operable air discharge passageway in each of said spark plugs in said predetermined cylinders, said one passageway communicating at one end thereof with atmosphere and with said cylinder at the other end thereof when said venting means is in said operative position.

3. A fuel saving apparatus according to claim 2, wherein each of said spark plugs in said predetermined cylinders comprises a hollow shell having inner and outer ends, said shell having said inner end in communication with said cylinder and extending outwardly therefrom; an actuator located inside said shell, said one passageway communicating at said one end thereof with at least one outlet port in said shell connected to atmosphere and at said other end thereof with said inner end of said shell; and said actuator having a valve for closing said inner end of said shell, said actuator being supported for motion relative to said shell between a first position where said valve closes said inner end of said shell and said operative position where said valve opens said inner end of said shell thereby venting said cylinder through said one passageway and one outlet port.

4. A fuel saving apparatus according to claim 3, further including means for biasing said actuator to said first position, and means for moving said actuator to said operative position against the force of said biasing means.

5. A fuel saving apparatus according to claim 4, wherein said moving means comprises a rod pivotally mounted on said engine, at least one eccentrically mounted roller fixed on said rod and bearing against a ring fixed on said actuator, and means for rotating said rod in response to actuation of said control means to cause said roller to move said ring, and thereby said actuator, to said operative position.

6. A fuel saving apparatus according to claim 5, wherein said biasing means comprises a spring disposed between said ring and said outer end of said shell.

7. A fuel saving apparatus according to claim 1, wherein said means for preventing fuel flow comprises a plurality of slideable valve plates each having an opening therein normally registering with a fuel intake passageway connecting to one of said predetermined cylinders, and said valve plates in said operative position having said openings disposed in a non-registering condition with said fuel intake passageways.

8. A fuel saving apparatus according to claim 7, wherein each of said slideable valve plates is movably installed in a gasket placed in each of said fuel intake passageways.

9. A fuel saving apparatus according to claim 7, wherein said cylinders are each provided with an intake valve for controlling the entry of fuel into said cylinders under the control of a camshaft in said engine, the operation of said intake valves being independent of the operation of said slideable valve plates and said control means.

10. Venting means for a cylinder of an internal combustion engine including a combustion chamber defined by at least one wall, an aperture in said wall, and an ignition means disposed within said aperture, comprising:

a venting valve means disposed in said aperture and having a normally closed position;

means for opening said venting valve means;

said ignition means and said venting valve means in its said normally closed position preventing the passage of gaseous material from said cylinder through said aperture during engine operation, means for supplying fuel to said combustion chamber, and means for shutting off said fuel supply when said means for opening said venting valve means is operated to cause opening of said venting valve means.

* * * * *